US005389157A

United States Patent [19]

Smith

[11] Patent Number: 5,389,157

[45] Date of Patent: * Feb. 14, 1995

[54] VISCOELASTIC CLEANING COMPOSITIONS WITH LONG RELAXATION TIMES

[75] Inventor: William L. Smith, Pleasanton, Calif.

[73] Assignee: The Clorox Company, Oakland, Calif.

[ * ] Notice: The portion of the term of this patent subsequent to Apr. 30, 2008 has been disclaimed.

[21] Appl. No.: 74,277

[22] Filed: Jun. 8, 1993

Related U.S. Application Data

[60] Continuation of Ser. No. 622,213, Nov. 30, 1990, abandoned, which is a continuation of Ser. No. 416,571, Oct. 3, 1989, abandoned, which is a division of Ser. No. 196,907, May 20, 1988, Pat. No. 4,900,467.

[51] Int. Cl.[6] ..... B08B 9/02

[52] U.S. Cl. ..... 134/22.13; 134/22.14

[58] Field of Search ..... 134/22.13, 22.14, 22.11; 252/98, 102, 110, 95, 103, 117, 527, 547, 546, 156, 526, 525, 550, 549, 554, 558, DIG. 14

[56] References Cited

U.S. PATENT DOCUMENTS

| | | | |
|---|---|---|---|
| 2,834,737 | 5/1958 | Farkas | 252/187 |
| 3,523,826 | 8/1970 | Lissant | 134/22 |
| 3,560,389 | 2/1971 | Hunting | 252/95 |
| 3,684,722 | 8/1972 | Hynam et al. | 252/98 |
| 3,697,431 | 10/1972 | Summerfelt | 252/103 |
| 4,080,305 | 3/1978 | Holdt et al. | 252/103 |
| 4,113,645 | 9/1978 | DeSimone | 252/187 H |
| 4,271,030 | 6/1981 | Brierley et al. | 252/98 |
| 4,337,163 | 6/1982 | Schilp | 252/96 |
| 4,375,421 | 3/1983 | Rubin et al. | 252/110 |
| 4,388,204 | 6/1983 | Dimond | 252/98 |
| 4,395,344 | 7/1983 | Maddox | 252/99 |
| 4,396,525 | 8/1983 | Rubin | 252/174.25 |
| 4,399,050 | 8/1983 | Bentham et al. | 252/95 |
| 4,540,506 | 9/1985 | Jacobson et al. | 252/174.12 |
| 4,576,728 | 3/1986 | Stoddart | 252/102 |
| 4,587,032 | 5/1986 | Rogers | 252/174.17 |
| 4,610,800 | 9/1986 | Durham et al. | 252/174.12 |
| 4,800,036 | 1/1989 | Rose et al. | 252/102 |
| 4,800,036 | 1/1989 | Rose et al. | 252/102 |
| 4,853,146 | 8/1989 | Rörig et al. | 252/142 |
| 4,986,929 | 1/1991 | Hoffman | 252/102 |
| 5,011,538 | 4/1991 | Smith | 132/22.13 |
| 5,041,239 | 8/1991 | Rörig et al. | 252/315.1 |
| 5,078,896 | 1/1992 | Rörig et al. | 252/102 |

FOREIGN PATENT DOCUMENTS

| | | | |
|---|---|---|---|
| 841936 | 9/1976 | Belgium . | |
| 129980 | 5/1983 | European Pat. Off. . | |
| 178931 | 4/1986 | European Pat. Off. . | |
| 185528 | 6/1986 | European Pat. Off. . | |
| 204472 | 12/1986 | European Pat. Off. . | |
| 0233666 | 8/1987 | European Pat. Off. | C11D 3/395 |
| 260205 | 3/1988 | France | C11D 1/90 |
| 123700 | 6/1986 | Japan | C11D 3/48 |
| 1128411 | 9/1967 | United Kingdom | C11D 3/02 |
| 1329086 | 9/1973 | United Kingdom . | |
| 1466560 | 3/1977 | United Kingdom . | |
| 1548379 | 7/1979 | United Kingdom . | |
| 2046321 | 11/1980 | United Kingdom . | |
| 2185036 | 7/1987 | United Kingdom . | |

OTHER PUBLICATIONS

Hoffman et al, "Rheology of Surfactant Solutions" *Tenside Detergents* (22) 1985 (month unknown).

Hoffman et al, "Viscoelastic Detergent Solutions from Rodlike Micelles" *ACS Symposium Series,* vol. 272 (1985) (month unknown).

Bayer et al, "The Influence of Solubilized Additives . . . " *Advances in Colloid and Interface Science* vol. 26, 1986 (month unknown).

*Primary Examiner*—Prince Willis, Jr.

*Attorney, Agent, or Firm*—Michael J. Mazza

[57] ABSTRACT

A thickened aqueous cleaning composition is viscoelastic, with a long relaxation time to provide a thick solution with consumer-acceptable pour properties. The composition has utility as a drain opening composition or as a hard surface cleaner having a cleaning-effective residence time on non-horizontal surfaces. The composition includes a cleaning active, and a binary thickener comprising a betaine or sulfobetaine having a $C_{14-18}$ alkyl, or $C_{10-18}$ alkylamino or alkylamido group, and an organic, anionic counterion. The composition preferably has a relaxation time of at least about 5 seconds and a relative elasticity between about 10–500 sec/Pa.

3 Claims, No Drawings

VISCOELASTIC CLEANING COMPOSITIONS WITH LONG RELAXATION TIMES

This is a continuation of application Ser. No. 07/622/213, filed Nov. 20, 1990, now abandoned itself a continuation of Ser. No. 07/416,571, filed Oct. 3, 1989, now abandoned, itself a division of Ser. No. 07/196,907, filed May 20, 1988, now U.S. Pat. No. 4,900,467.

BACKGROUND OF THE INVENTION

1. Field of The Invention

The present invention relates to thickener for cleaning compositions, the thickener having a shear-thinning, viscoelastic rheology with long relaxation times, and in particular to cleaning compositions thickened therewith incorporating a bleach and which are formulated to have utility as drain cleaners, or which are formulated to have utility as hard surface cleaners.

2. Description of Related Art

Much art has addressed the problem of developing a thickened cleaning composition, which may contain a bleach and may have utility as a hard surface cleanser. The efficacy of such compositions is greatly improved by viscous formulations, increasing the residence time of the cleaner. Splashing during application and use is minimized, and consumer preference for a thick product is well documented. U.S. Pat, No. 4,375,421, issued to Rubin et al describes a viscous, nonhypochlorite-containing composition containing at least five percent of amido and sulfobetaines, and water-soluble organic or inorganic salts such as sulfates and carbonates. Alkaryl sulfonates are specifically mentioned as possible surfactants for the composition. Rubin et al is distinguishable, however, in that there is no disclosure of the composition being viscoelastic, and alkyl betaines are specifically excepted from those which are useful. Schilp, U.S. Pat. No. 4,337,163 shows a hypochlorite thickened with an amine oxide or a quaternary ammonium compound, and a saturated fatty acid soap, and mentions that a $C_{8-18}$ alkyl betaine may be incorporated at levels about equal to the amine oxide (1.5 wt.%). Stoddart, U.S. Pat. No. 4,576,728 shows a thickened hypochlorite including 3- or 4-chlorobenzoic acid, 4-bromobenzic acid, 4-toluic acid and 3-nitrobenzoic acid in combination with an amine oxide, and mentions that a $C_{8-18}$ alkyl betaine may be incorporated at levels about equal to the amine oxide (1.5 wt. %). Neither Schilp nor Stoddart disclose any thickening or theological benefits by the optional inclusion of their betaines. DeSimone, U.S. Pat. No. 4,113,645 discloses a method for dispersing a perfume in hypochlorite using a quaternary ammonium compound. Bentham et al, U.S. Pat. No. 4,399,050, discloses hypochlorite thickened with certain carboxylated surfactants, amine oxides and quaternary ammonium compounds. Jeffrey et al, GB 1,466,560 shows bleach with a thickener comprising a sarcosinate or tauride surfactant, and a soap, quaternary ammonium compound, betaine, amine oxide, or alkanolamide. Farkas, U.S. Pat. No. 2,834,737 describes an unthickened hypochlorite bleach having about 0.05–1% of a $C_{10-16}$ alkyl betaine as a foaming agent and to mask the hypochlorite odor. Hynam, U.S. Pat. No. 3,684,722 describes an alkali-metal hypochlorite which is thickened by a surface active agent, which may be a $C_{8-18}$ alkyl betaine and a $C_{8-18}$ soap. Hardy et el, EP 129,980 discloses hypochlorite, an amine oxide or betaine, and an organosilicon quaternary ammonium compound as a bactericide, and is limited to an ionic strength of below about 5.0 g moles/dm$^3$. Gray, GB 1,548,379 describes a thickened bleach incorporating a sucrose surfactant with a quaternary ammonium compound, an amine oxide, a betaine, an alkanolimide, or combinations thereof.

For various reasons, the prior art thickened hypochlorite compositions are not commercially viable. In many instances, thickening is insufficient to provide the desired residence time on non-horizontal surfaces. Adding components, and/or modifying characteristics of dissolved components often creates additional problems with the composition, such as syneresis, which require adding further components in an attempt to correct these problems. Polymer thickened hypochlorite bleaching compositions tend to be oxidized by the hypochlorite. Prior art thickened bleach products generally exhibit phase instability at elevated (above about 49° C.) and/or low (below about 2° C.) storage temperatures. Difficulties exist with colloidal thickening agents in that these tend to exhibit either false-bodied or thixotropic rheologies, which, at high viscosities, can result in a tendency to set up or harden. Other hypochlorite compositions of the prior art are thickened with surfactants and may exhibit hypochlorite stability problems. Surfactant thickening systems also are not cost effective when used at the levels necessary to obtain desired product viscosity values. European Patent Application 204,472 to Stoddart describes shear-thinning compositions, and seeks to avoid viscoelasticity in such shear-thinning compositions.

Drain cleaners of the art have been formulated with a variety of actives in an effort to remove the variety of materials which can cause clogging or restriction of drains. Such actives may include acids, bases, enzymes, solvents, reducing agents, oxidants and thioorganic compounds. Such compositions are exemplified by U.S. Pat. Nos. 4,080,305 issued to Holdt et al; 4,395,344 to Maddox; 4,587,032 to Rogers; 4,540,506 issued to Jacobson et al; 4,610,800 to Durham et al; and European Patent Applications 0,178,931 and 0,185,528, both to Swann et al. Generally, workers in this field have directed their efforts toward actives, or combinations of actives, which would have improved efficacy or speed when used on typically-encountered clog materials; or are safer to use. A problem with this approach, however, is that regardless of the effectiveness of the active, if the composition is not fully delivered to the clog, the effectiveness of the active will be diminished. This is particularly apparent where the clogged drain results in a pool of standing water, and a drain opener composition added to such standing water will be substantially diluted thereby. The above European Patent Applications of Swann et al disclose an attempt to overcome the delivery problem by encapsulating actives in polymeric beads. The Rogers and Durham et al patents refer to the delivery problem and mention that a thickener is employed to increase the solution viscosity and mitigate dilution. Similarly, a thickener is optionally included in the formulation of Jacobson et al.

SUMMARY OF THE PRESENT INVENTION

In view of the prior art, there remains a need for a thickened cleaning composition with a shear-thinning viscoelastic rheology having a long relaxation time. There further remains a need for a viscoelastic, thickened cleaning composition which is bleach and phase-stable, even at high viscosities and low temperatures, and can be economically formulated.

It is therefore an object of the present invention to provide a viscoelastic, thickened cleaning composition.

It is another object of the present invention to provide a cleaning composition having utility as a drain cleaner by virtue of a viscoelastic rheology.

It is yet another object of the present invention to provide a drain cleaning composition which is highly effective.

It is yet another object of the present invention to provide a viscoelastic thickened cleaning composition which is phase-stable during normal storage, and at elevated or very low temperatures, even in the presence of bleach.

It is another object of the present invention to provide a stable thickened hypochlorite composition with a viscoelastic rheology.

It is another object of the present invention to provide a viscoelastic thickening system which is effective at both high and low ionic strength.

It is another object of the present invention to provide a cleaning composition having a viscoelastic rheology to simplify filling of containers during manufacturing, and to facilitate dispensing by the consumer.

It is yet another object of the present invention to provide a composition having a viscoelastic rheology and a long relaxation time to mask displeasing flow properties inherent in such viscoelastic theologies.

Briefly, a first embodiment of the present invention comprises a stable cleaning composition having a viscoelastic rheology comprising, in aqueous solution:

(a) an active cleaning compound;

(b) a betaine or sulfobetaine having a $C_{14-18}$ alkyl group, or a $C_{10-18}$ alkylamino or alkylamido group; and (c) an anionic organic counterion.

It should be noted that as used herein the term "cleaning" refers generally to a chemical, physical or enzymatic treatment resulting in the reduction or removal of unwanted material, and "cleaning composition" specifically includes drain openers, hard surface cleaners and bleaching compositions. The cleaning composition may consist of a variety of chemically, physically or enzymatically reactive active ingredients, including solvents, acids, bases, oxidants, reducing agents, enzymes, detergents and thioorganic compounds.

Viscoelasticity is imparted to the cleaning composition by a binary system including a betaine or sulfobetaine having a $C_{14-18}$ alkyl group, or a $C_{10-18}$ alkylamino or alkylamido group, and an anionic organic counterion that is thought to promote elongated micelles. Preferably the betaine is a $C_{14-18}$ alkyl betaine and the counterion is a $C_{2-6}$ alkyl carboxylate, aryl carboxylate, $C_{2-10}$ alkyl sulfonate, aryl sulfonate, sulfated aryl or $C_{2-10}$ alkyl alcohols, and mixtures thereof. Most preferably the counterion is an aryl sulfonate, e.g. sodium xylene sulfonate. The counterion may include substituents which are chemically stable with the active cleaning compound. Preferably, the substituents are alkyl or alkoxy groups of 1–4 carbons, halogens and nitro groups, all of which are stable with most actives, including hypochlorite. The viscosity of the formulations of the present invention can range from slightly greater than that of water, to several thousand centipoise (cP). Preferred from a consumer standpoint is a viscosity range of about 20 cP to 1000 cP, more preferred is about 50 cP to 500 cP.

A second embodiment of the present invention is a composition and method for cleaning drains, the composition comprising, in aqueous solution:

(a) a drain opening active;

(b) a betaine or sulfobetaine having a $C_{14-18}$ alkyl group, or a $C_{10-18}$ alkylamino or alkylamido group; and (c) an anionic organic counterion.

The composition is utilized by pouring an appropriate amount into a clogged drain. The viscoelastic thickener acts to hold the active components together, allowing the solution to travel through standing water with very little dilution. The viscoelastic thickener also yields increased percolation times through porous or partial clogs, affording longer reaction times to enhance clog removal. The long relaxation times increase consumer acceptance of the product, and the shear-thinning simplifies filling and dispensing.

In a third embodiment the present invention is formulated as a thickened hypochlorite-containing composition having a viscoelastic rheology, and comprises, in aqueous solution:

(a) a hypochlorite bleach;

(b) a $C_{14-18}$ alkyl betaine or $C_{10-18}$ alkyl, alkylamino, or alkylamido sulfobetaine; and (c) a bleach-resistant anionic organic counterion.

It is an advantage of the present invention that the cleaning composition is thickened, with a viscoelastic rheology.

It is another advantage of the present invention that the viscoelastic thickener is chemically and phase-stable in the presence of a variety of cleaning actives, including hypochlorite, and retains such stability at both high and low temperatures.

It is another advantage of the present invention that the composition is stable and viscoelastic, and relatively low in cost, and owing to its long relaxation time appears to pour very smoothly, which can increase consumer acceptance.

It is another advantage of the present invention that, when formulated as a drain cleaner the composition travels rapidly through standing water with little dilution, improving the efficacy of the cleaner.

It is another advantage of the present invention that the improved efficacy resulting from the viscoelastic theology allows for safer drain cleaning formulations with lower levels of, or less toxic, actives.

It is a further advantage of the present invention that the viscoelastic thickener is effective at both high and low ionic strength.

It is a further advantage of the composition of the present invention that the shear-thinning behavior facilitates container filling, and dispensing.

It is yet another advantage of the composition of the present invention that thickening is achieved with relatively low levels of surfactant, improving chemical and physical stability.

These and other objects and advantages of the present invention will no doubt become apparent to those skilled in the art after reading the following Detailed Description of the Preferred Embodiments.

DETAILED DESCRIPTION OF THE PREFERRED EMBODIMENTS

In a first embodiment, the present invention is a thickened viscoelastic cleaner comprising, in aqueous solution;

(a) an active cleaning compound;

(b) a betaine or sulfobetaine having a $C_{14-18}$ alkyl group, or a $C_{10-18}$ alkylamino or alkylamido group; and (c) an anionic organic counterion.

Active Cleaning Compounds

A number of cleaning compounds are known and are compatible with the viscoelastic thickener. Such cleaning compounds interact with their intended target materials either by chemical or enzymatic reaction or by physical interactions, which are hereinafter collectively referred to as reactions. Useful reactive compounds thus include acids, bases, oxidants, reductants, solvents, enzymes, thioorganic compounds, surfactants (detergents) and mixtures thereof. Examples of useful acids include: carboxylic acids such as citric or acetic acids, weak inorganic acids such as boric acid or sodium bisulfate, and dilute solutions of strong inorganic acids such as sulfuric acid. If present, the acid must be sufficiently weak and/or dilute to avoid decreasing the pH of the composition to a point where the counterion becomes protonated. Examples of bases include the alkali metal hydroxides, carbonates, and silicates, and specifically, the sodium and potassium salts thereof. Oxidants, e.g., bleaches are a particularly preferred cleaning active, and may be selected from various halogen or peroxygen bleaches. Examples of suitable peroxygen bleaches include hydrogen peroxide and peracetic acids. Examples of enzymes include proteases, amylases, and cellulases. Useful solvents include saturated hydrocarbons, ketones, carboxylic acid esters, terpenes, glycol ethers, and the like. Thioorganic compounds such as sodium thioglycolate can be included to help break down hair and other proteins. Various nonionic, anionic, cationic or amphoteric surfactants can be included, as known in the art, for their detergent properties. Examples include taurates, sarcosinates and phosphate esters. Preferred cleaning actives are oxidants, especially hypochlorite, and bases such as alkali metal hydroxides. Most preferred is a mixture of hypochlorite and an alkali metal hydroxide. The cleaning active is added in a cleaning-effective amount, which may range from about 0.05 to 50 percent by weight, depending on the active. The maximum amount of cleaning active depends on how the active interacts with the betaine micelles which form in the aqueous system. For instance, water-insoluble solvents or other organic materials that are solubilized in the interior of these micelles may be present in a molar amount about equal to that of the betaine. Large polar molecules like long chain alcohols and cosurfactants that are solubilized between betaine molecules in the micelles are generally limited to molar concentrations less than that of the betaine. Such large polar molecules, however, are often preferred because they enhance thickening or improve other properties like phase stability. Small polarizable compounds like toluene and butanol, which are solubilized in the palisade region of the micelle, can destroy the structure of the micelles responsible for viscoelastic thickening, thus are not preferred. The palisade region is defined by M. J. Rosen in *Surfactants and Interfacial Phenomena*, John Wiley & Sons, page 125 (1978), as the region "between the hydrophilic groups and the first few carbon atoms of the hydrophobic groups that comprise the outer core of the micellar interior". Cleaning actives, e.g. sodium hypochlorite, that do not actively interact with the betaine micelles are limited only by their own solubilities in water.

Betaine

Operative betaines include the $C_{14-18}$ alkyl betaines and $C_{14-18}$ alkyl sulfobetaines. Especially preferred is acetyl dimethyl betaine (CEDB) such as ARMOTAINE 16 (a trademarked product of AKZO Chemie America), which is about 75% $C_{16}$, 12% $C_{14}$ and 11% $C_{18}$. It is noted that when referring to carbon chain lengths of the betaine or any other compound herein, the commercial, polydisperse forms are contemplated. Thus, a given chain length within the preferred $C_{14-18}$ range will be predominately, but not exclusively, the specified length. As used herein in reference to the betaine or sulfobetaine, the term "alkyl" includes both saturated and unsaturated groups. Fully saturated alkyl groups are preferred in the presence of hypochlorite. $C_{10-18}$ alkylamido and alkylamino betaines, and sulfobetaines having $C_{14-18}$ alkyl, or $C_{10-18}$ alkylamino or alkylamido groups, are also suitable for use in the compositions of the present invention. The pH of the composition must be maintained at a level high enough to keep the betaine in its zwitterionic form. The sulfobetaine will function at lower pH's, thus is preferred at such lower pHs.

The betaine is added at levels, which, when combined with the counterion, are thickening effective. Generally about 0.1 to 10.0 weight percent of the betaine is utilized, preferred is to use about 0.1 to 5.0% betaine, and most preferred is about 0.15–2.0 percent betaine.

Counterion

The counterion is an anionic organic counterion selected from the group consisting of $C_{2-6}$ alkyl carboxylates, aryl carboxylates, $C_{2-10}$ alkyl sulfonates, aryl sulfonates, sulfated $C_{2-10}$ alkyl alcohols, sulfated aryl alcohols, and mixtures thereof. The aryl compounds are derived from benzene or napthalene and may be substituted or not. The alkyls may be branched or straight chain, and preferred are those having two to eight carbon atoms. The counterions may be added in acid form and converted to the anionic form in situ, or may be added in artionic form. Suitable substituents for the alkyls or aryls are $C_{1-4}$ alkyl or alkoxy groups, halogens, nitro groups, and mixtures thereof. Substituents such as hydroxy or amine groups are suitable for use with some non-hypochlorite cleaning actives, such as solvents, surfactants and enzymes. If present, a substituent may be in any position on the rings. If benzene is used, the para (4) and meta (3) positions are preferred. In some circumstances the cleaning active itself may be within the class of thickening-effective counterions. For example, some carboxylic acid cleaning actives may be present in both the acid and conjugate base forms, the latter which could serve as the counterion. The $C_{2-6}$ alkyl carboxylates may act in this manner. The counterion is added in an amount sufficient to thicken and result in a viscoelastic theology, and preferably between about 0.01 to 10 weight percent. A preferred mole ratio of betaine to counterion depends on the chain length and concentration of the betaine, type of counterion, and the ionic strength of the solution, as well as whether the primary object of the composition is phase stability or viscosity. Using CEDB and sodium xylene sulfonate, a preferred mole ratio is about 10:1 to 1:3, and more preferred is about 2:1 to 1:2. Without limiting to a particular theory, it is thought that the anionic counterions promote the formation of elongated micelles of the betaine. These micelles can form a network which results in efficient thickening. It has been surprisingly found that the viscoelastic thickening as defined herein occurs when the counterion, selected from the class as defined above, is minimally or nonsurface-active. Minimally or nonsurface-active counterions are defined, for the present purposes to have a critical micelle concentration (CMC) of greater than about 0.1 molar as measured in water at room temperature (about 21° C.). The experimental data show that, generally, the counterions of the present invention should be soluble in water. Table I shows the effects of betaine and counterion concentrations, and type of counterion, on viscosity and phase stability. The betaine in each example is CEDB, and about 5.5–5.8 weight percent sodium hypochlorite, 5–6 weight percent sodium chloride, and about 1.4–1.9 weight percent sodium hydroxide are also present. Also demonstrated is the high degree of shear-thinning of the composition. It is noted that formulas 1–3 actually exhibit some degree of shear-thinning (see e.g. formula 3),due to the presence of salts such as sodium chloride. In Table I, and following Tables II–IV, the physical properties of the compositions were measured no sooner than two days after the sample was made to allow sufficient time for the thickening structures of the composition to form.

TABLE I

| | Betaine | Counterion | | Effect of Counterions Viscosity (cP) | | Number of Phases | | | | | | Temp. |
|---|---|---|---|---|---|---|---|---|---|---|---|---|
| No. | Wt. % | Wt. % | Name | 3 rpm | 30 rpm | −18 | −12 | −1 | 21 | 38 | 49 | (°C.) |
| 1 | 0.500 | | None | 10 | 11 | — | — | — | 1 | — | — | |
| 2 | 0.750 | | None | 80 | 58 | — | — | — | 1 | — | — | |
| 3 | 1.000 | | None | 1570 | 297 | 2 | 2 | 1 | 1 | 1 | 2 | |
| 4 | 0.500 | 0.100 | BA | 640 | 116 | 2 | 2 | 2 | 1 | 1 | 2 | |
| 5 | 0.500 | 0.050 | BA | 410 | 110 | 2 | 2 | 2 | 1 | 2 | 2 | |
| 6 | 0.500 | 0.150 | BA | 250 | 95 | 2 | 2 | 2 | 1 | 2 | 2 | |
| 7 | 0.500 | 0.050 | BSA | 610 | 131 | 2 | 2 | 2 | 1 | 2 | 2 | |
| 8 | 0.500 | 0.150 | BSA | 720 | 131 | 2 | 2 | 1 | 1 | 2 | 2 | |
| 9 | 0.500 | 0.050 | TSA | 690 | 140 | 2 | 2 | 2 | 1 | 2 | 2 | |
| 10 | 0.500 | 0.150 | TSA | 830 | 155 | 2 | 2 | 1 | 1 | 2 | 2 | |
| 11 | 0.158 | 0.142 | SXS | 40 | 17 | 1 | 2 | 1 | 1 | 1 | 1 | |
| 12 | 0.278 | 0.222 | SXS | 190 | 50 | 1 | 1 | 1 | 1 | 1 | 1 | |
| 13 | 0.389 | 0.311 | SXS | 420 | 105 | 1 | 1 | 1 | 1 | 1 | 1 | |
| 14 | 0.500 | 0.050 | SXS | 1010 | 181 | — | — | — | 1 | — | — | |
| 15 | 0.500 | 0.200 | SXS | 980 | 190 | 1 | 1 | 1 | 1 | 1 | 2 | |
| 16 | 0.500 | 0.400 | SXS | 270 | 108 | 1 | 1 | 1 | 1 | 1 | 1 | |
| 17 | 0.529 | 0.371 | SXS | 800 | 185 | 1 | 1 | 1 | 1 | 1 | 1 | |
| 18 | 0.750 | 0.050 | SXS | 950 | 180 | 1 | 2 | 1 | 1 | 2 | 2 | |
| 19 | 0.750 | 0.100 | SXS | 1100 | 207 | 2 | 2 | 2 | 1 | 2 | 2 | |
| 20 | 0.750 | 0.200 | SXS | 1780 | 270 | — | — | — | 1 | — | — | |
| 21 | 0.500 | 0.100 | NaOSA | 630 | 135 | 1 | 1 | 1 | 1 | 2 | 2 | |
| 22 | 0.500 | 0.400 | NaOSA | 360 | 228 | 1 | 1 | 1 | 1 | 1 | 2 | |

Betaine = Alkyl dimethylbetaine; alkyl is 75% $C_{16}$, 12% $C_{14}$, and 11% $C_{18}$.
In addition to the above salts, all formulas contain 5.8 wt. % of sodium hypochlorite, 5.8 wt. % of sodium chloride, 0.25 wt % of sodium carbonate, 1.5 wt. % of sodium hydroxide, and 0.113 wt. % of sodium silicate; $SiO_2/Na_2O$ = 3.22.
Viscosities were measured at 22–26° C. with a Brookfield rotoviscometer model LVTD using cylindrical spindle #2.
BA = Benzoic acid
BSA = Benzenesulfonic acid
TSA = Toluenesulfonic acid
SXS = Sodium Xylenesulfonate
OSA = Octylsulfonate The viscoelasticity of the thickener including shear-thinning and long relaxation times advantageously imparts unusual flow properties to the cleaning composition. Elasticity causes the stream to break apart and snap back into the bottle at the end of pouring instead of forming syrupy streamers. Further, elastic fluids appear more viscous than their viscosity indicates. Instruments capable of performing oscillatory or controlled stress creep measurements can be used to quantify elasticity. Some parameters can be measured directly (set Hoffmann and Rehage, *Surfactant Science Series,* 1987, Vol. 22, 299–239 and EP 204,472), or they can be calculated using models. Increasing relaxation times indicate increasing elasticity, but elasticity can be moderated by increasing the resistance to flow. Since the static shear modulus is a measure of the resistance to flow, the ratio of the relaxation time (Tau) to the static shear modulus (G0) is used to measure relative elasticity. Tau and G0 can be calculated from oscillation data using the Maxwell model. Tau can also be calculated by taking the inverse of the frequency with the maximum loss modulus. G0 is then obtained by dividing the complex viscosity by Tau. To obtain the full benefits of the viscoelastic thickener, the Tau/G0 (relative elasticity) should be between about 10–500 sec/Pa, more preferred is between about 20–250 sec/Pa. The relative elasticity can be varied by varying the types and concentrations of betaine and counterions, and by adjusting the relative concentrations of counterions and betaine.

Some consumers do not like the appearance of elastic flow properties. Previous teachings, for example Stoddart, EP 204,472, sought to minimize elasticity to improve consumer acceptance. Thus, a relaxation time of less than about 0.5 seconds at 10° C. was considered to be the upper limit of consumer preference. Contrary to such teachings, it has surprisingly been found that solutions can be made to appear acceptably smooth by greatly increasing the relaxation time. If the relaxation time (Tau) is greater than about 5 and preferably 10 seconds, and the Tau/G0 is between about 10–500 sec/Pa, the objectionable pour properties of viscoelastic solutions are not observed, and the solutions appear to flow smoothly. The other approach of the art to enhance consumer acceptance of viscoelastic compositions is to minimize elasticity, as taught, e.g. in Stoddart, EP 204,472. By contrast, the invention herein does not require any reduction in elasticity, thus the solutions retain the full benefits of such elasticity for applications such as drain-opening formulations.

It is noted that viscosities reported herein are shear viscosities, i.e. those measured by a resistance to flow perpendicular to the stress vector. However, the parameter which most accurately defines the rheology of the present invention is-extensional viscosity, i.e. uniaxial resistance to flow along the stress vector. Because a means of directly measuring extensional viscosity in solutions as described herein is not yet available, the relative elasticity parameter (Tau/G0) is used as an approximation. It is noted that if a means of measuring extensional viscosity becomes available, such means could be used to further define the scope of the present invention.

In the second embodiment of the present invention a composition suitable for opening drains is provided comprising, in aqueous solution:

(a) a drain opening active (b) a betaine or sulfobetaine having a $C_{14-18}$ alkyl group, or a $C_{10-18}$ alkylamino or alkylamido group; and (c) an anionic organic counterion.

Table II shows the effect of composition on rheology and corresponding drain cleaning performance. The latter is measured by two parameters: (1) percentage diluted; and (2) flow rate. Percentage diluted was measured by pouring 20 mL of the composition, at 23° C., into 80 mL of standing water, and measuring the amount of undiluted product delivered. A percentage diluted of 100% indicates that all product has mixed with standing water; a percentage diluted of 0% indicates that all of the product has reached the clog with substantially no mixing with standing water. Flow rate was measured by pouring 100 mL of the composition at 24° C. through a 3.2 cm diameter, No. 230 US mesh screen and recording the time to pass through the screen. A low flow rate is preferred for a drain-opener because it means a longer contact time between the drain-opener and porous or partially porous clogs. A preferred percentage diluted is less than about 25%, more preferred is less than about 10%, and most preferred is less than about 5%. A preferred flow rate is less than about 100 mL/minute, more preferred is less than about 50 mL/minute. Rheology was measured with a Bolin VOR rheometer at 25° C. in the oscillatory mode. The viscosity is the in-phase component extrapolated to 0 Hertz. The relaxation time, Tau, and the static shear modulus, G0, were calculated using the Maxwell model. The ratio Tau/G0 is, as previously described, postulated to be a measure of relative elasticity.

TABLE II

Effect at Composition on Rheology and Drain Opener Performance

| No. | Betaine Wt % | SXS Wt % | Viscosity cP 0 Hz | Viscosity cP 2 Hz | Tau sec | GO Pa | Tau/GO Sec/Pa | % Diluted | Flow Rate mL/min |
|---|---|---|---|---|---|---|---|---|---|
| 1 | 0.158 | 0.142 | 50 | 3 | 6.5 | 0.025 | 258 | 23 | 71 |
| 2 | 0.188 | 0.169 | 92 | 5 | 9.9 | 0.044 | 224 | — | 46 |
| 3 | 0.263 | 0.237 | 316 | 7 | 18.8 | 0.100 | 188 | 8 | — |
| 4 | 0.278 | 0.222 | 319 | 8 | 19.7 | 0.122 | 161 | 5 | 43 |
| 5 | 0.294 | 0.206 | 568 | 9 | 19.2 | 0.148 | 130 | 5 | 36 |
| 6 | 0.350 | 0.140 | — | — | — | — | — | 4 | 27 |
| 7 | 0.370 | 0.330 | 432 | 12 | 12.1 | 0.214 | 57 | 2 | 32 |
| 8 | 0.389 | 0.311 | 668 | 12 | 18.5 | 0.244 | 76 | 3 | 35 |
| 9 | 0.412 | 0.288 | 1150 | 12 | 19.4 | 0.368 | 53 | 4 | 20 |
| 10 | 0.500 | 0.400 | 851 | 23 | 10.0 | 0.446 | 22 | 2 | 40 |

Betaine - Alkylbetaine; alkyl is 75% $C_{16}$, 12% $C_{14}$, and 11% $C_{18}$.
SXS = Sodium Xylenesulfonate
All formulas contain S.8 wt. % of sodium hypochlorite, 4.5-6 wt. % of sodium chloride, 0.25 wt. % of sodium carbonate, 1.5 wt. % of sodium hydroxide, and 0.113 wt. % of sodium silicate; $SiO_2/Na_2O$ = 3.22.

The viscoelastic compositions herein represent a substantial departure from compositions of the prior art in that elasticity, rather than simply viscosity, is the crucial parameter to the success of the invention. The viscoelastic thickener provides surprising advantages when formulated as a drain cleaner. Because the elastic components hold the solution together, it will travel through standing water with very little dilution, delivering a high percentage of active to the clog. The elasticity results in a higher delivery rate of active than a purely viscous solution of the same viscosity. This is true even if the viscous component (G0) of the solution is low. Thus, viscosity alone will not result in good performance, but elasticity alone will, and a solution which is elastic and has some viscosity will result in superior performance. Such purely viscous solutions, furthermore, do not achieve their highest delivery rates unless the viscosity is very high (above about 1000 cP). This presents other problems, including difficulty in dispensing at low temperatures, poor penetration into clogs, reduced consumer acceptance, and high cost associated with attaining such high viscosities. The elasticity also yields increased percolation times through porous or partial clogs, surprisingly increasing the effectiveness of a drain opening composition.

Table III compares performance vs. rheology for four formulations: an unthickened control, a sarcosinate, nonelastic thickened formulation, a slightly elastic formulation of a surfactant and a soap, and a viscoelastic formulation of the present invention. The percentage diluted and flow rate parameters were measured as in Table II. From Table III, it can be seen that formulas 1, 2 and 3 have high percentage diluted values and relatively high flow rates (formula 1 has a very high flow rate). The percentage diluted of formula 3 is about twenty-five times greater than that of the viscoelastic formula 4 of the present invention. This is surprising since the purely viscous component (measured by G0 is much less for formula 4 than for formulas 2 or 3.

The superior performance of formula 4 thus appears to be due to its greater elasticity as measured by Tau.

TABLE III

Perfomance Versus Rheology

| Viscosity | Tau | GO | Tau/GO | Flow Rate[b] |
|---|---|---|---|---|

TABLE III-continued

| Perfomance Versus Rheology | | | | | | | |
|---|---|---|---|---|---|---|---|
| Formula | Rheology | cP | sec | Pa | sec/Pa | % Dilution[a] | mL/min |
| 1 | unthickened | 1 | 0 | 0 | 0 | 100 | 2400 |
| 2 | thickened nonelastic | 141 | 0.12 | 7.64 | 0.016 | 94 | 92 |
| 3 | thickened elastic | 334 | 0.35 | 6.06 | 0.058 | 53 | 52 |
| 4 | viscoelastic | 432 | 12.1 | 0.21 | 57 | 2 | 32 |

[a]Percentage of product that does not pass through standing water to the clog. Twenty mL of product at 23° C. was poured into 80 mL of standing water.
[b]Rate of flow for product at 23° C. through a 230 mesh sieve.

| Formula | Wt. % | Compound | Wt. % | Compound | Wt. % | Compound |
|---|---|---|---|---|---|---|
| 1 | | | contains no thickeners | | | |
| 2 | 1.6 | MDMAO | 0.37 | Sarcosinate(1) | 0.03 | Primacor 5980(2) |
| 3 | 0.8 | MDMAO | 0.25 | Laurie Acid | — | — |
| 4 | 0.37 | CEDB | 0.33 | SXS | | |

(1)Sodium lauroyl sarcosinate
(2)A trademarked product of the Dow Chemical Co., comprising a copolymer of acrylic acid and ethylene
All fomulas contain 5.8 wt. % sodium hypochlorite, 1.75 wt. % sodium hydroxide, 5.8 wt. % sodium chloride and 0.11 wt. % sodium silicate ($SiO_2/Na_2O$ = 3.22).
MDMAO = Myristyldimethylamine oxide
CETAC = Cetyltrimethyl ammonium chloride
4-CBA = 4-chlorobenzoic acid
SXS = Sodium Xylenesulfonate
CEDB = Cetyl dimethyl betaine The maximum benefits of the viscoelastic rheology of the drain cleaning composition of the present invention are attained when the composition is denser than water, enabling it to penetrate standing water, While less dense compositions still benefit from the viscoelastic rheology when applied to drains having porous or partial clogs, the full benefit is obtained when the composition possesses a density greater than water. In many instances, this density is attained without the need for a densifying material. In formulations containing sodium hypochlorite, for example, sufficient sodium chloride is present with the hypochlorite to afford a density greater than water. When necessary to increase the density, a salt such as sodium chloride is preferred and is added at levels of 0 to about 20%.

The cleaning active is an acid, base, solvent, oxidant, reductant, enzyme, surfactant or thioorganic compound, or mixtures thereof, suitable for opening drains. Such materials include those as previously described in the first embodiment which act by either chemically reacting with the clog material to fragment it or render it more water-soluble or dispersable, physically interacting with the clog material by, e.g., adsorption, absorption, solvation, or heating (i.e. to melt grease), or by enzymatically catalyzing a reaction to fragment or render the clog more water-soluble or dispersable. Particularly suitable are alkali metal hydroxides and hypochlorites. Combinations of the foregoing are also suitable. The drain opener may also contain various adjuncts as known in the art, including corrosion inhibitors, dyes and fragrances.

A preferred example of a drain cleaning formulation includes:

(a) a $C_{14-18}$ alkyl betaine or sulfobetaine;
(b) an anionic organic counterion;
(c) an alkali metal hydroxide;
(d) an alkali metal silicate;
(e) an alkali metal carbonate; and
(f) an alkali metal hypochlorite Components (a) and (b) comprise the viscoelastic thickener and are as described previously in the first embodiment. The alkali metal hydroxide is preferably potassium or sodium hydroxide, and is present in an amount of between about 0.5 and 20% percent. The preferred alkali metal silicate is one having the formula $M_2O(SiO)_n$ where M is an alkali metal and n is between 1 and 4. Preferably M is sodium and n is 3.2. The alkali metal silicate is present in an amount of about 0 to 5 percent. The preferred alkali metal carbonate is sodium carbonate, at levels of between about 0 and 5 percent. About 1 to 15 percent hypochlorite is present, preferably about 4 to 8.0 percent.

In a third embodiment, a viscoelastic hypochlorite cleaning composition is provided and comprises, in aqueous solution (a) a $C_{14-18}$ alkyl betaine or sulfobetaine;
(b) a bleach-resistant anionic organic counterion; and
(c) a hypochlorite bleaching species.

The composition of the third embodiment may have utility as a hard surface cleaner. Hypochlorite may also be incorporated into a drain opening composition, as previously described. The thick solutions are clear and transparent, and can have higher viscosities than hypochlorite solutions of the art. Because viscoelastic thickening is more efficient, less surfactant is needed to attain the viscosity, and chemical and physical stability of the composition generally is better. Less surfactant also results in a more cost-effective composition. As a hard surface cleaner, the viscoelastic theology prevents the composition from spreading on horizontal sources and thus aids in protecting nearby bleach-sensitive surfaces. The viscoelasticity also provides the benefits of a thick system e.g. increased residence time on non-horizontal surfaces. Generally, the preferred betaine for use with hypochlorite is an alkyl dimethyl betaine or sulfobetaine compound having a 14 to 18 carbon alkyl group, and most preferably the betaine is CEDB. The alkylamido betaines and alkylamino betaines are not preferred in the presence of hypochlorite. Also when hypochlorite is present, the composition is most stable with no more than about 1.0 weight percent betaine, although up to about 10 weight percent betaine can be used. Substituted benzene sulfonic acids are preferred as the counterion with xylene sulfonic acid being most preferred. In the presence of bleach, hydroxyl, amino, and carbonyl substituents on the counterion should be avoided.

A bleach source may be selected from various hypochlorite-producing species, for example, halogen bleaches selected from the group consisting of the alkali metal and alkaline earth salts of hypohalite, haloamines, haloimines, haloimides and haloamides. All of these are believed to produce hypohalous bleaching species in situ. Hypochlorite and compounds producing hypochlorite in aqueous solution are preferred, although hypobromite is also suitable. Representative hypochlorite-producing compounds include sodium, potassium, lithium and calcium hypochlorite, chlorinated trisodium phosphate dodecahydrate, potassium and sodium dicholoroisocyanurate and trichlorocyanuric acid. Organic bleach sources suitable for use include heterocyclic N-bromo and N-chloro imides such as trichlorocyanuric and tribromo-cyanuric acid, dibromo- and dichlorocyanuric acid, and potassium and sodium salts thereof, N-brominated and N-chlorinated succinimide, malonimide, phthalimide and naphthalimide. Also suitable are hydantoins, such as dibromo and dichloro dimethyl-hydantoin, chlorobromodimethyl hydantoin, N-chlorosulfamide (haloamide) and chloramine (haloamine). Particularly preferred in this invention is sodium hypochlorite having the chemical formula NaOCl, in an amount ranging from about 0.1 weight percent to about 15 weight percent, more preferably about 0.2% to 10%, and most preferably about 2.0% to 6.0%. It may be necessary to add a buffer or other alkaline agent to increase the composition pH to above about 10.0, preferably about 12.0 to maintain the storage stability of the composition.

Advantageously, the viscoelastic thickener is not significantly diminished by ionic strength, nor does it require ionic strength for thickening. Surprisingly, the viscoelastic compositions of the present invention are phase-stable and retain their rheology in solutions with more than about 4 weight percent ionizable salt, e.g., sodium chloride and sodium hypochlorite. It is believed that the composition theology will remain stable at levels of ionizable salt of between about 5 and 20 percent, corresponding to an ionic strength of between about 1–4 g-ions/Kg. It is also expected that the viscoelastic rheology would remain even at ionic strengths of at least about 6 g-ions/Kg. Table IV shows the chemical stability of some hypochlorite-containing compositions of the present invention.

TABLE IV

FORMULA

| Chemical | Weight Percent Active I | II | III |
|---|---|---|---|
| Sodium Hypochlorite | 5.79 | 5.76 | 5.78 |
| Sodium Hydroxide | 1.46 | 1.44 | 1.52 |
| Sodium Chloride | 5.77 | 5.77 | 5.77 |
| Sodium Carbonate | 0.25 | 0.25 | 0.25 |
| Sodium Silicate(1) | 0.11 | 0.11 | 0.11 |
| Alkyldimethylbetaine(2) | 0.21 | 0.37 | 0 |
| Sodium Xylenesulfonate | 0.19 | 0.33 | 0 |
| Composition Ionic Strength (g-ions/Kg) | 2.57 | 2.59 | 2.55 |

STABILITY (1)$SiO_2/Na_2O$ = 3.22
(2)Alkyl is 75% $C_{16}$, 12% $C_{14}$, and 11% $C_{18}$.

| Time (weeks) | Percent NaOCl Remaining 38° C. I | II | III | 49° C. I | II | III |
|---|---|---|---|---|---|---|
| 1 | | | | 71 | 64 | 80 |
| 2 | 74 | 66 | 83 | 56 | 51 | 65 |
| 4 | 61 | 54 | 70 | | | |
| 8 | 46 | 40 | 53 | | | |
| 12 | 37 | 33 | 43 | | | |

| (weeks) | Percent Viscosity Remaining 38° C. I | II | 49° C. I | II |
|---|---|---|---|---|
| 1 | | | 85 | 75 |
| 2 | 79 | 87 | 79 | 83 |
| 4 | 82 | 82 | | |
| 8 | 49 | 77 | | |
| 12 | 21 | 74 | | |

Optional Ingredients

A principal optional ingredient is a cosurfactant which can enhance the cleaning-effectiveness, or the viscosity and/or phase stability of the composition. Examples of preferred cosurfactants include amine oxides, sarcosinates, taurates and quaternary ammonium compounds. Viscosity of the compositions herein may be enhanced by including aliphatic and aromatic hydrocarbon oils such as hexadecane and dodecylbenzene. Buffers and pH adjusting agents may be added to adjust or maintain pH. Examples of buffers include the alkali metal phosphates, polyphosphates, pyrophosphates, triphosphates, tetraphosphates, silicates, metasilicates, polysilicates, carbonates, hydroxides, and mixtures of the same. Certain salts, e.g., alkaline earth phosphates, carbonates, hydroxides, etc., can also function as buffers. It may also be suitable to use as buffers such materials as aluminosilicates (zeolites), borates, aluminates and bleach-resistant organic materials, such as gluconates, succinates, maleates, and their alkali metal salts. These buffers function to keep the pH ranges of the present invention compatible with the cleaning active, depending on the embodiment. Control of pH may be necessary to maintain the stability of the cleaning active, to avoid protonating the betaine and to maintain the counterion in anionic form. In the first instance, a cleaning active such as hypochlorite is maintained above about pH 10, preferably above or about pH 12. The counterions, on the other hand, generally don't require a pH higher than about 8 and may be as low as pH 5–6. Counterions based on strong acids may tolerate even lower pH's. The total amount of buffer including that inherently present with bleach plus any added, can vary from about 0.0% to 25%.

The composition of the present invention can be formulated to include such components as fragrances, coloring agents, whiteners, solvents, soil release polymers, bacteriocidal agents, chelating agents and builders, which enhance performance, stability or aesthetic appeal of the composition. From about 0.01% to about 0.5% of a fragrance such as those commercially available from International Flavors and Fragrance, Inc. may be included in any of the compositions of the first, second or third embodiments. Dyes and pigments may be included in small amounts. Ultramarine Blue (UMB) and copper phthalocyanines are examples of widely used pigments which may be incorporated in the composition of the present invention. Suitable builders which may be Optionally included comprise carbonates, phosphates and pyrophosphates, exemplified by such builders function as is known in the art to reduce the concentration of free calcium or magnesium ions in the aqueous solution. Certain of the previously mentioned buffer materials, e.g. carbonates, phosphates, phosphonates, polyacrylates and pyrophosphates also function as builders.

While described in terms of the presently preferred embodiment, it is to be understood that such disclosure is not to be interpreted as limiting. Various modifications and alterations will no doubt occur to one skilled in the art after having read the above disclosure. Accordingly, it is intended that the appended claims be interpreted as covering all such modifications and alterations as fall within the true spirit and scope of the invention.

I claim:

1. A method for clearing restrictions caused by organic materials in drain pipes comprising (a) introducing to a drain pipe having an organic restriction therein an aqueous drain opening composition comprising a cleaning-effective amount of a drain opening active and a viscoelastic thickening system wherein the composition has a relative elasticity between about 10–500 sec/Pa, a relaxation time of at least about 5 seconds, a dilution percentage of less than about 25%, a flow rate Of less than about 100 ml/minute, and a viscosity of at least about 20 cP;

(b) allowing the composition to remain in contact with the organic restriction material to react therewith; and (c) rinsing the composition and restriction away.

2. The method of claim 1 wherein the drain opening active is selected from the group consisting of acids, bases, oxidants, reductants, solvents, enzymes, detergents, thioorganic compounds, and mixtures thereof.

3. The method of claim 1 wherein the viscoelastic thickener comprises (a) a betaine or sulfobetaine having a $C_{14-18}$ alkyl group, or a $C_{10-18}$ alkylamino or alkylamido group; and (b) an anionic organic counterion selected from the group consisting of $C_{2-6}$ alkyl carboxylates, aryl carboxylates, $C_{2-10}$ alkyl sulfonates, aryl sulfonates, sulfated $C_{2-10}$ alkyl alcohols, sulfated aryl alcohols, and mixtures thereof, and the betaine and counterion are present in an amount sufficient to thicken and to result in the viscoelastic rheology.

* * * * *